US005862967A

United States Patent [19]

Johnson

[11] Patent Number: 5,862,967

[45] Date of Patent: Jan. 26, 1999

[54] EQUIPMENT SUPPORT FRAME FOR USE WITH BACKPACKS AND THE LIKE

[76] Inventor: Scott Johnson, HC5 Box 135, Roseau, Minn. 56751

[21] Appl. No.: 974,620

[22] Filed: Nov. 19, 1997

[51] Int. Cl.[6] ..... A45F 4/00

[52] U.S. Cl. ..... 224/577; 224/153; 224/632; 224/576; 224/908; 224/913; 248/177.1

[58] Field of Search ..... 248/177, 121, 248/127, 188, 188.5; 224/153, 632, 908, 913, 576, 577

[56] References Cited

U.S. PATENT DOCUMENTS

| | | | |
|---|---|---|---|
| 3,493,153 | 2/1970 | Spady, Jr. et al. | 224/153 X |
| 4,738,383 | 4/1988 | Dearborn et al. | 224/153 X |
| 4,896,804 | 1/1990 | Dearborn et al. | 224/153 |
| 5,284,280 | 2/1994 | Stonebraker, Sr. et al. | 224/153 |
| 5,433,358 | 7/1995 | Millard | 224/153 |

*Primary Examiner*—Ramon O. Ramirez
*Attorney, Agent, or Firm*—Michael J. Tavella

[57] ABSTRACT

A frame system that converts to a four-leg support base for use with backpacks. The base eliminates the need to carry a tripod or monopod. Two threaded bosses are use to accommodate attachments such as a shooting rest or to accommodate surveillance or test equipment. The main part of the frame replaces the top hoop found on many external frame backpacks. The frame has two angled members that accept a pair of legs. These legs are made of several parts to permit many configurations. The frame can be removed from the backpack as well. This makes a free standing base that can be used in seated or prone positions; it also leaves the pack portion free to be used separately. Nylon sides or hoods can be attached to make the pack assembly act as a blind or a windbreak. Also, an aluminum table can be attached to the frame for cooking, etc., as desired.

13 Claims, 12 Drawing Sheets

EQUIPMENT SUPPORT FRAME FOR USE WITH BACKPACKS AND THE LIKE

TITLE OF THE INVENTION

Equipment Support Frame For Use With Backpacks And The Like

This invention relates to equipment supports for cameras, guns and the like and particularly to equipment supports for cameras, guns and the like, that have a frame integral with a backpack frame.

BACKGROUND OF THE INVENTION

Outdoor activities are an increasing part of our lifestyle. Hunting, camping and backpacking account for billions of dollars in equipment sales and permit fees. Other than car camping or use of a recreational vehicle, all overnight and many-day outdoor activities require the use of some type of backpack to hold gear, equipment, clothing and food. Many backpack styles have been designed to carry this equipment and these designs work well.

Many outdoor activities require the use of other types of equipment as well. For example, hunters often use rifles and spotting scopes. Many people carry cameras, which can be rather large if professional photographs are desired. In using these devices, some type of support is needed as well, such as a tripod. Because standard tripods tend to be heavy and cumbersome to carry into the field, lightweight tripods and even monopods have been developed. Despite their convenience, these supports are still bulky and sometimes heavy to carry. This reduces the amount of other supplies that can be carried and often limits the length of the trip to the field.

BRIEF SUMMARY OF THE INVENTION

The instant invention overcomes these problems. It is a frame system that converts to a four-leg base. This base eliminates the need to carry a tripod or monopod. The frame accepts an ultralight head for spotting scopes, binoculars, cameras, and camcorders. Two threaded bosses are provided to hold attachments such as a shooting rest, or to accommodate surveillance or test equipment. The top of the frame is wide enough to hold both supports. Thus, a hunter can have a spotting scope mounted on one side of the frame and a shooting support on the other.

The main part of the frame is designed to replace the top hoop found on many external frame backpacks. In ordinary use, the main frame acts like the hoop of an ordinary backpack. The frame is designed with two angled members that accept a pair of legs. These legs, when attached to the frame, make the pack into a "quadpod".

The threaded bosses are attached to the top of the main frame. When the frame is set up, many types of devices can be attached to the bosses. The ballast of the backpack makes the stand very sturdy and stable, even in windy conditions.

The support frame can be removed from the backpack as well. This makes a free standing base that can be used in seated or prone positions; it also leaves the pack portion free to be used separately.

As in all backpacking, weight is a critical factor. The frame and legs are designed from all welded aluminum construction. Stainless steel fasteners are used for durability. When fully assembled, the unit weighs less than one pound. When stored on the backpack, there is no bulky packaging. The unit conforms the dimensions of the backpack. This not only produces an ultralight support system, but also one that saves valuable pack space.

Other attachments are available. Nylon sides or hoods can be attached to make the pack assembly act as a blind or a windbreak. Also, an aluminum table can be attached to the frame for cooking, etc., as desired.

DETAILED DESCRIPTION OF THE INVENTION

Figure 1:
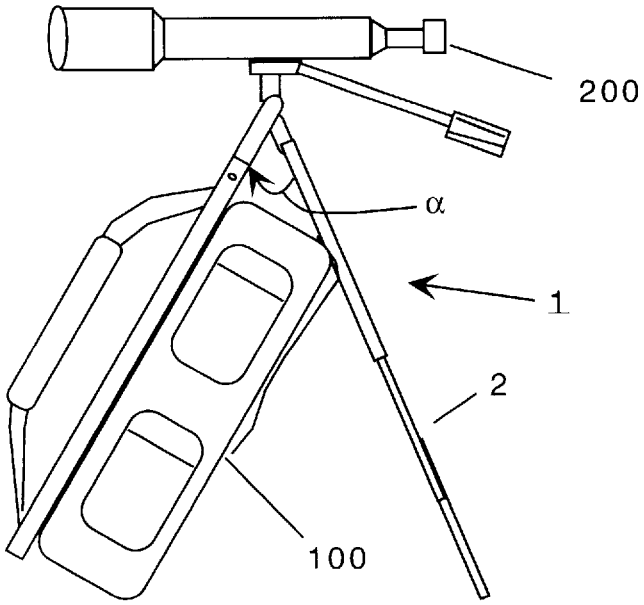
FIG. 1 is a side view of the preferred embodiment, fully assembled.
Figure 2:
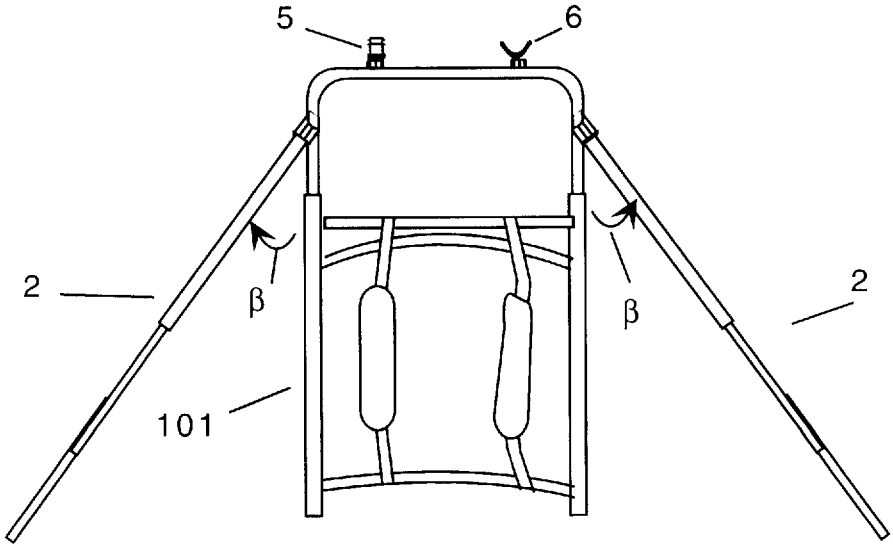
FIG. 2 is a rear view of the preferred embodiment, as fully assembled.
Figure 3:
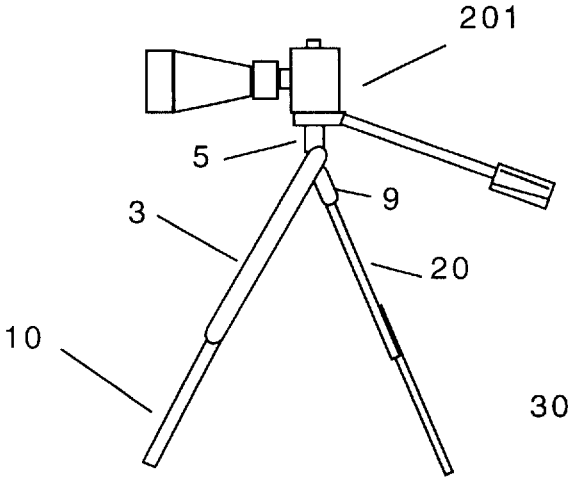
FIG. 3 is a side view of a second embodiment of the frame system.
Figure 4:
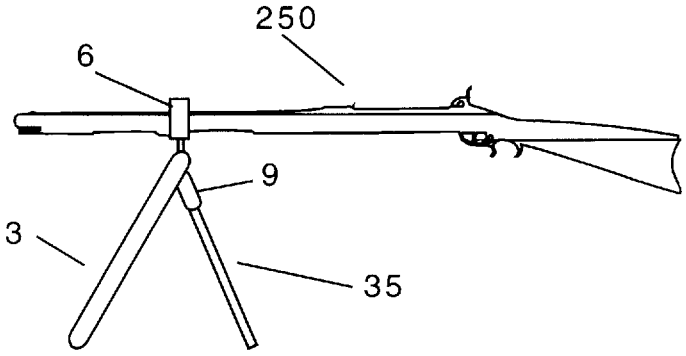
FIG. 4 is side view of a third embodiment of the frame system.

Referring now to FIGS. 1 and 2, the basic makeup of my equipment support is shown. FIG. 1 shows a side view of the system as fully assembled. My support is designed to be used with a backpack 100. As shown in FIGS. 1 and 2, it is not necessary to remove the back pack to use the system 1. In fact, the backpack 100 acts to help stabilize the support. As shown in FIGS. 1 and 2, two telescoping legs 2 are used to hold the back pack and convert it into a support structure. Various types of equipment supports are attached to equipment bosses 8 that are secured to a removable hoop 3 as shown in FIG. 2. It is also possible to use the support 1 without using a back pack. FIG. 3 shows one configuration of the support without a pack. FIG. 4 shows another configuration that uses even fewer components. This configuration is used for prone position shooting. These configurations are discussed in greater detail below.

Figure 5:
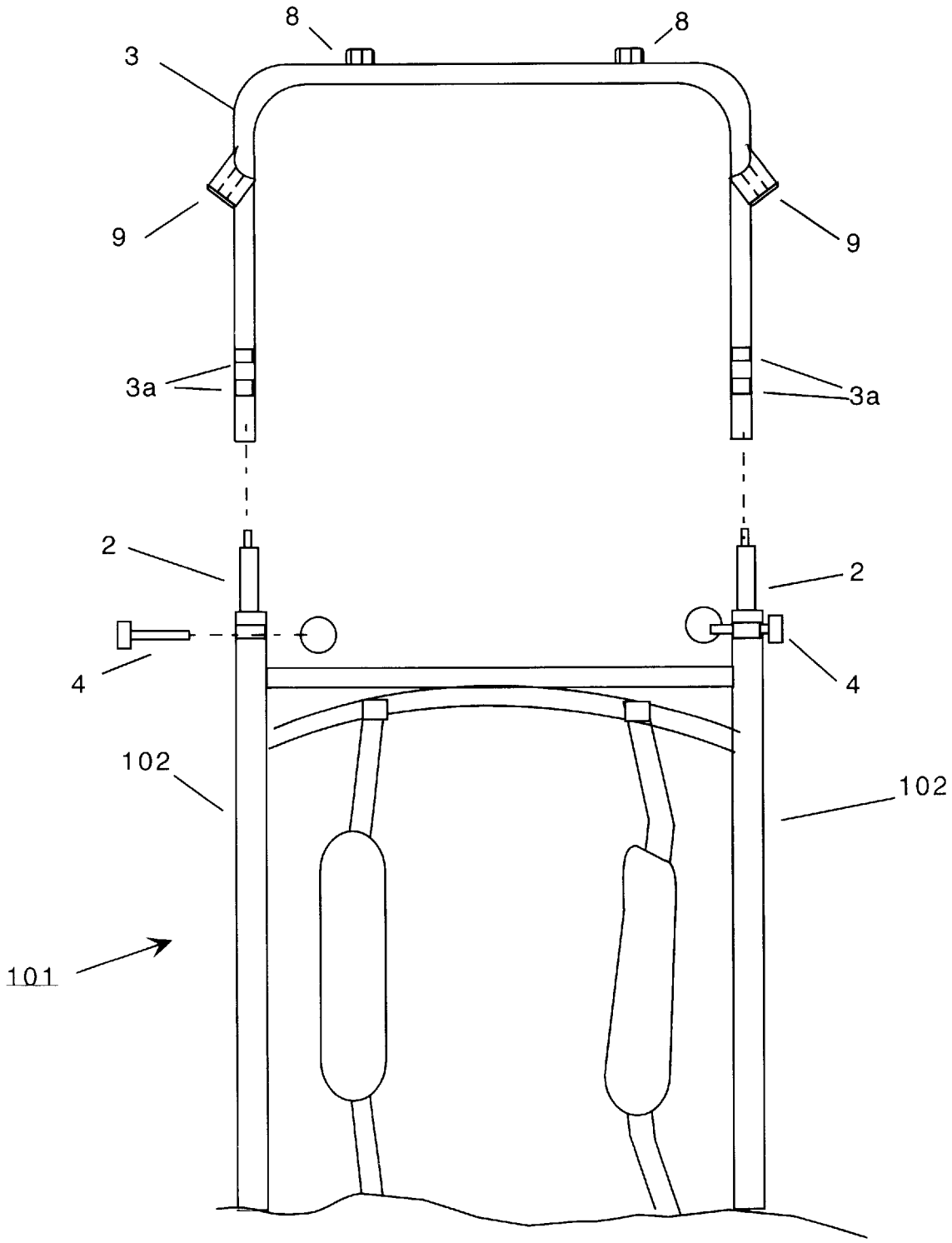
FIG. 5 is a rear detail partially exploded view of a backpack frame, showing the placement of frame components for storage.

The support 1 has several components. FIGS. 5–15 show details of all the components of the system 1. FIG. 5 shows the placement of the major components as carried in a back pack 100. Most external frame backpacks have a harness frame 101 that has two vertical frame members 102 as shown. Many backpack frames 101 have a curved hoop that can be used to tie equipment or other items. To use my system, the curved hoop is discarded and replaced with a new hoop 3. FIG. 5 shows the new hoop 3 as it aligns with the frame 101. Specific details of the hoop are discussed below. The two telescoping legs 2 are placed within the vertical frame members 102 for storage, as shown in FIG. 5. Once the legs 2 are stored, the hoop can be placed in the frame 101. Two pins 4 are used to secure the hoop to the frame as shown through holes 3*a* in the hoop 3 (see FIG. 5). At this point, the backpack can be used normally, with the support system being stored out of the way, ready for use. As described below, the support can be readily removed from the frame and assembled when needed, without difficulty.

Figure 6:
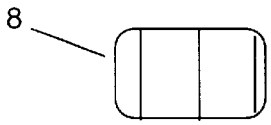
FIG. 6 is a side view of a threaded boss.
Figure 7:
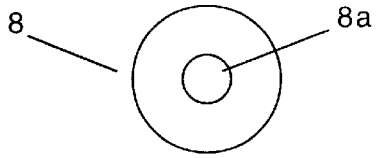
FIG. 7 is a top view of the threaded boss.

As shown in FIG. 5, the hoop 3 has a number of components attached to it. Two threaded bosses 8 are attached to the top of the hoop 3 as shown. FIGS. 6 and 7 show one of the threaded bosses 8. The bosses 8 are threaded with ¼–20 threads in a hole 8*a*, to accept a rifle rest or attachments for spotting scopes, etc. FIG. 6 is a side view of a boss 8 and FIG. 7 is a top view of the boss. The boss 8 is welded to the top hoop 3 as shown.

Figure 8A:
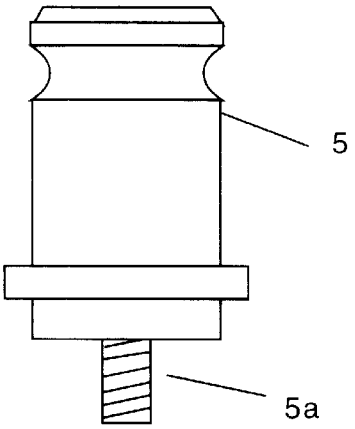
FIG. 8*a* is a side view of the universal equipment mount.
Figure 8B:
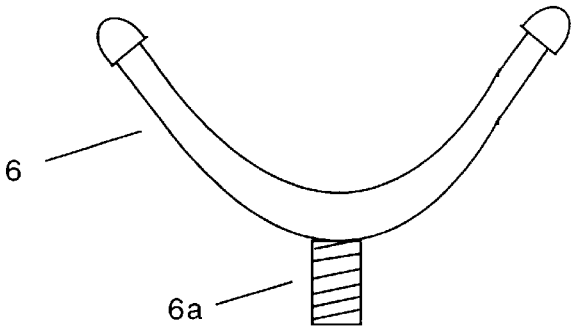
FIG. 8*b* is a side view of the gun support.

FIG. 8*a* shows a machined fitting 5 that accepts a mount such as a VELBON PH-241 camera mount (not shown). This mount is commonly used to secure cameras, video recorders and other similar types of equipment. This fitting 5 has a threaded stud 5*a* that screws into one of the bosses 8 that are welded to the hoop 3 as shown. FIG. 8*b* shows a "V" shaped gun support 6 that also has a threaded stud 6*a* for attaching the gun support 6 to one of the threaded bosses 8. In this way, it is possible to mount a spotting scope on the stud 5, on one side of the hoop 3, while supporting a rifle on the gun support 6 on the other side of the hoop 3. Of course, different mounts can be used as desired for any purpose. For example, a table 60 can be used, as discussed below.

Figure 9A:
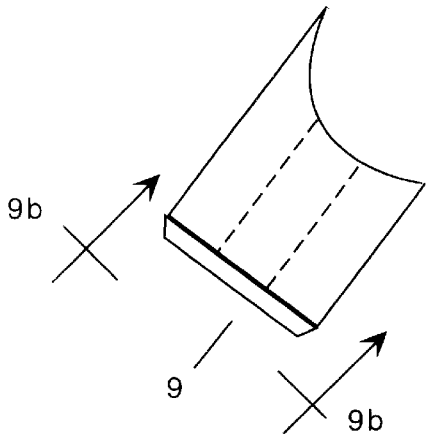
FIG. 9*a* is a side view of the leg support.
Figure 9B:
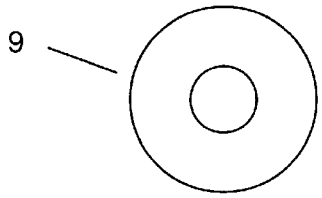
FIG. 9*b is an end view of the leg support.*

Returning to the structure of the device, FIG. 5 shows two angled members 9 that are attached to the top hoop 3 as shown. FIG. 9*a* is a side view of one of these angled members 9. In the preferred embodiment, the angled members 9 are 0.625 in solid aluminum stock that are formed as shown and are threaded and tapped to accept a ¼–20 stainless steel stud. See FIG. 9*b*. The angled members 9 are welded to the sides of the top hoop 3 as shown. In the preferred embodiment, the members are set back at an angle of 37° (angle $\alpha$) and are turned out at a 30° angle (angle $\beta$). See FIGS. 1 and 2, which illustrate these two angles.

Figure 10:
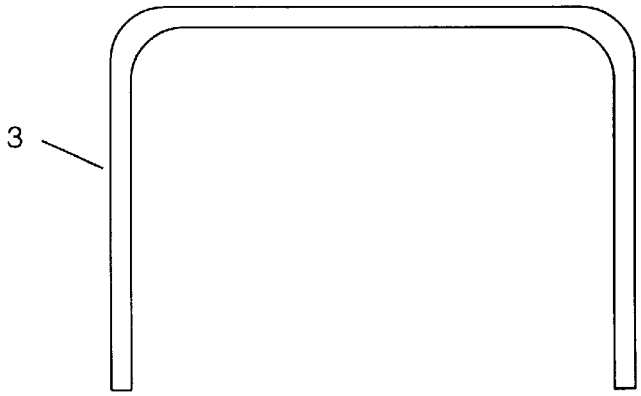
FIG. 10 is a front view of the main frame hoop, ready for modification.

FIG. 10 is a front view of the top hoop 3 before it is modified with the various members. In the preferred embodiment, this hoop 3 is a piece of 0.753 diameter by 0.062 inch wall aluminum tubing that is 36 inches long. It is bent with two 90° 3 inch radius bends as shown. This produces a center to center width between the bottom ends of the tube, of 13.375 inches. This dimension is important because it matches the width of the vertical members of most back pack frames. Of course, this dimension can be changed as desired to accommodate any size frame.

Figure 11:
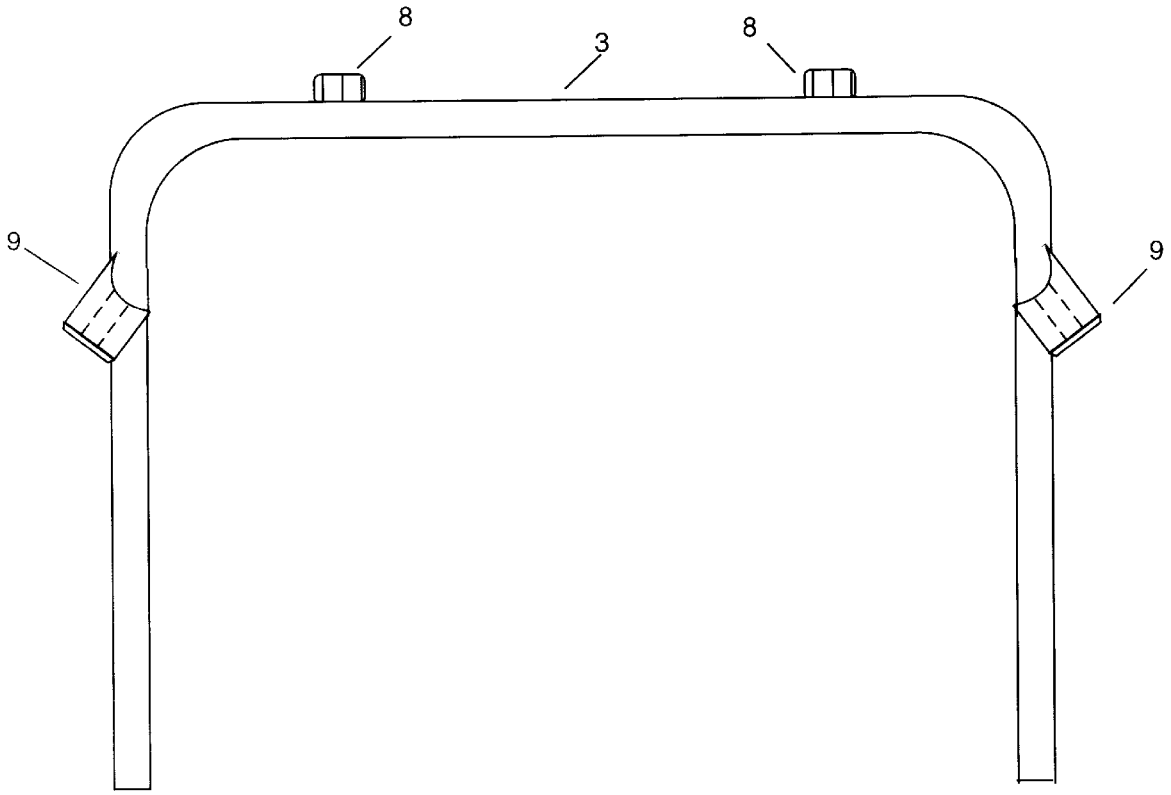
FIG. 11 is a rear view of the main frame hoop as fully modified, ready for use.
Figure 12:
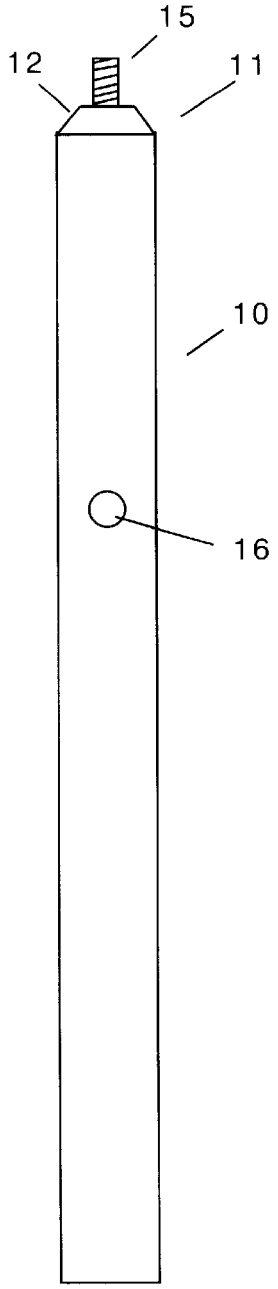
FIG. 12 is a side view of the upper leg member.

FIG. 11 shows a detail view of the top hoop 3 with the threaded bosses 8 and angled members 9, discussed above, welded in place.

FIGS. 12–15 show details of the telescoping leg system 2. In the basic system, three separate parts are used. The first, is the upper leg 10. See FIG. 12. This leg 10 has an overall length in the preferred embodiment of 15.5 inches. Of course, this length can vary as desired. The leg 10 is made of 0.625" outside diameter (o. d.) aluminum tubing that has a 0.5" inside diameter (i. d.). The top 11 of the leg 10 is closed with an aluminum insert 12 that is welded into the end of the leg 10 as shown. The insert 12 is fitted with a threaded stud 15 that has ¼–20 threaded to be compatible with the angled members that are attached to hoop 3. The leg 10 also has a mounting hole 16 as shown. This hole is used for securing the legs to the pack (see FIG. 5) and for use in the configuration of FIG. 3, as discussed below.

Figure 13:
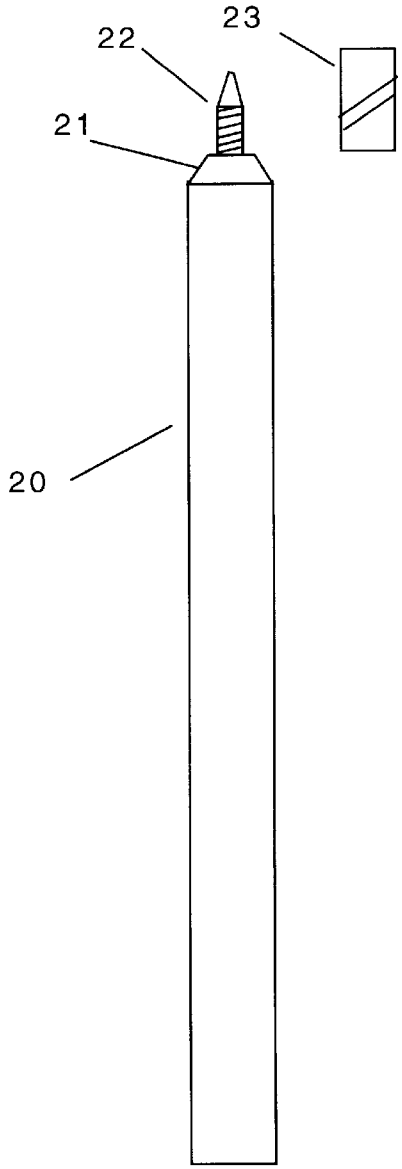
FIG. 13 is a side view of the center leg member.

FIG. 13 shows the center leg 20. This leg is the middle portion of the support legs as shown in FIGS. 1 and 2. It also forms the top portion of the rear legs in FIG. 3, as discussed below. In the preferred embodiment, the center leg 20 is 14.75" long and is made of 0.500 o. d. aluminum tube. This tube also has a 0.375" i. d. A plug 21 is tack welded to the inside of the leg 20 to support a ¼–20 threaded stud 22 that extends from one the top of leg 20 as shown. An expanding plug 23 screws onto the stud 22 this expanding plug 23 is used to secure the center leg within the top leg 10 when the full leg system is used (FIGS. 1 and 2). The center leg is inserted into top leg 10 until the expanding plug 23 is sufficiently covered. The center leg 20 is then turned until the expanding plug secures the leg 20 within the leg 10. Use of expanding plugs allows for the quick assembly of the legs and for fast adjustment of the legs as well.

Figure 14:
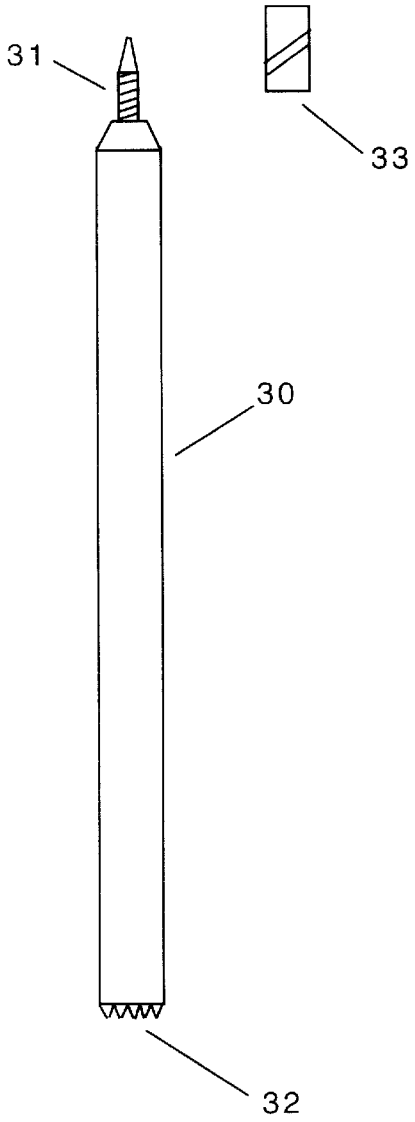
FIG. 14 is a side view of the lower leg member.

FIG. 14 shows the third (or lower) leg 30. This leg is shown at the bottom of the support system in FIGS. 1 and 2. In the preferred embodiment, leg 30 is made of 0.390" o. d. solid aluminum rod. A 10–32 threaded stud 31 is attached to one end of the rod as shown. The other end of the leg 30 is fitted with a rubber or plastic gripper foot 32. As in the case of the center leg 20, the third leg 30 has an expanding plug 33 that is secured to the 10–32 stud 31. The expanding plug 33 is used to secure the leg 30 into the center leg 20 in the same manner as that discussed above for the center leg.

Figure 15:
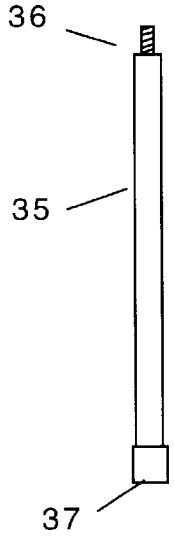
FIG. 15 is a side view of the auxiliary leg member.

The three legs form the basic structure for the support system. There are several other components for specialized functions. FIG. 15 shows an auxiliary leg 35 used in the configuration of FIG. 4 (this figure is discussed in greater detail below). The auxiliary leg 35 is made of aluminum rod and, in the preferred embodiment, is eight inches long. The leg 35 is fitted with a 14–20 stud 36 for fitting to the top leg 10 when used in the FIG. 4 configuration. A rubber foot 37 is provided to give the leg 35 a non-skid base.

Figure 16:
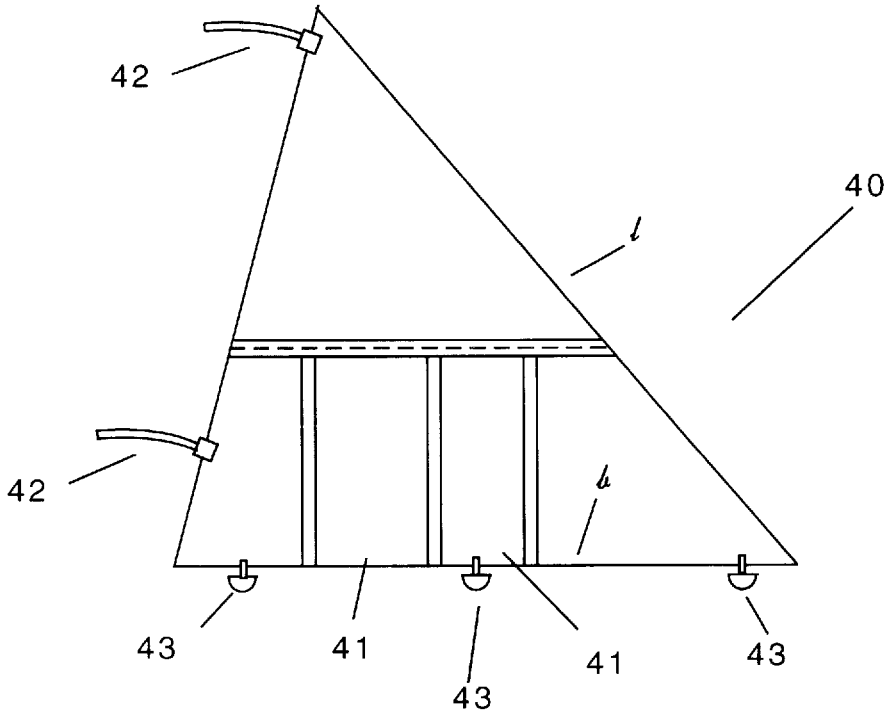
FIG. 16 is a side detail of a side hood.
Figure 19:
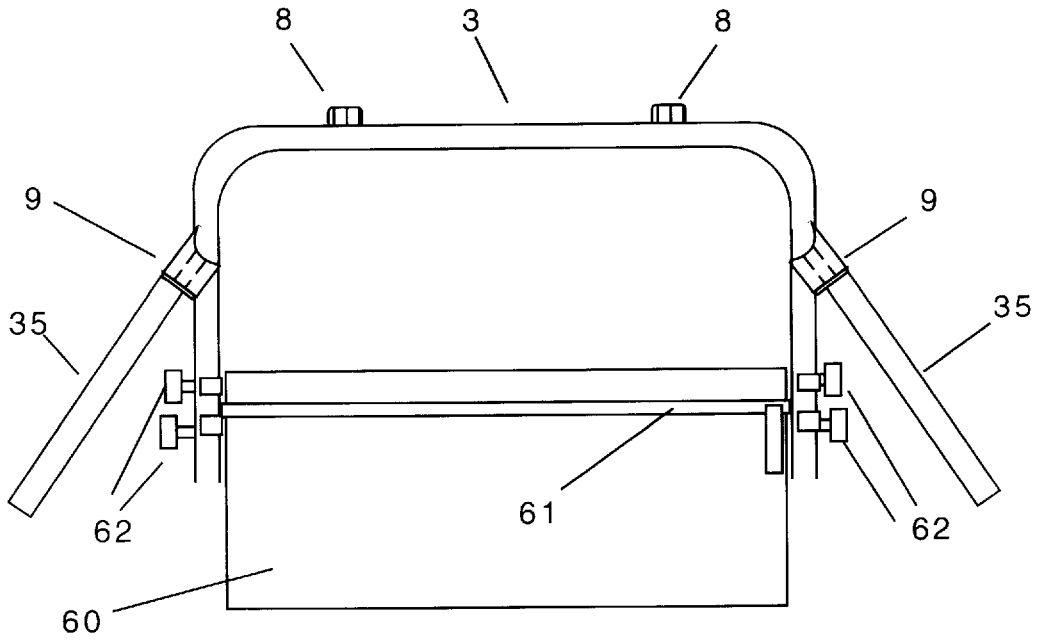
FIG. 19 is a detail view of the device with the weight bag in place.

FIG. 16 shows a hood or side piece 40 that is attached to the backpack as shown in FIG. 19. In the preferred embodiment, the hood 40 is made of CORDURA NYLON. The hood 40 can be made in solid colors or a camouflage pattern. The hood 40 can have a number of pockets 41 as shown. Straps 42 are provided as shown to attach the hood 40 to the backpack frame 101. Loops or D-rings 43 are provided to allow the hood 40 to be staked down. In the preferred embodiment, the long edge 1 of the hood 40 is 42 inches. The base b is 32 inches. The hood 40 can be used as a wind break or as a shelter or partial blind.

Figure 17:
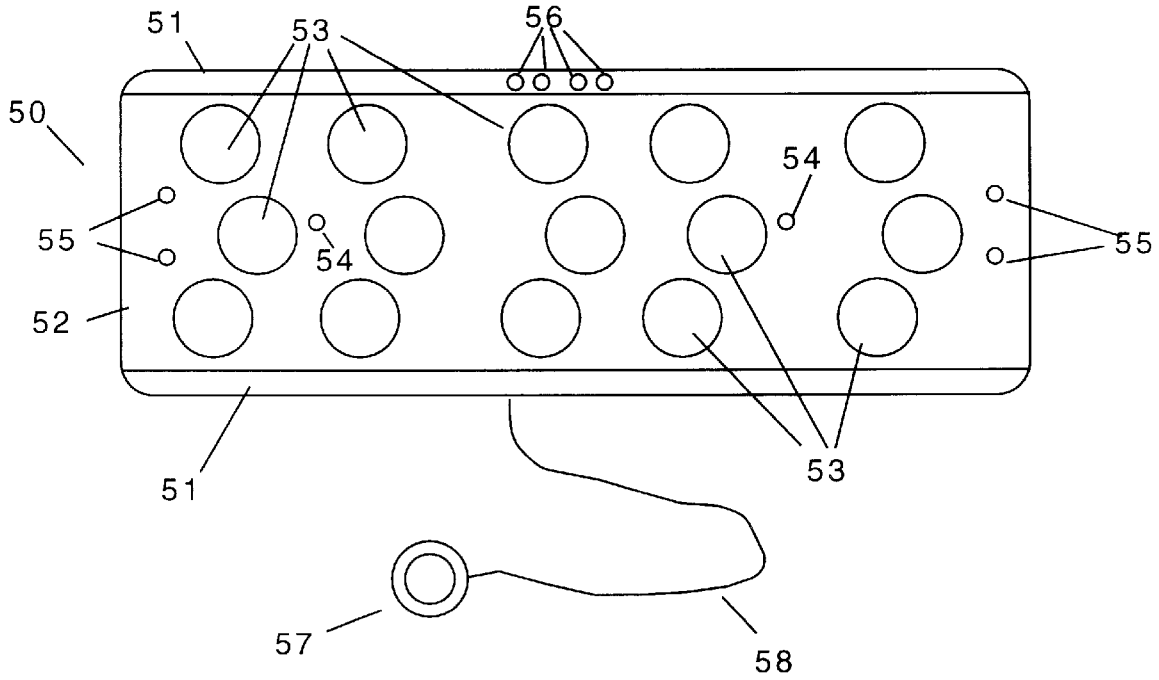
FIG. 17 is a top view of the portable table.
Figure 18:
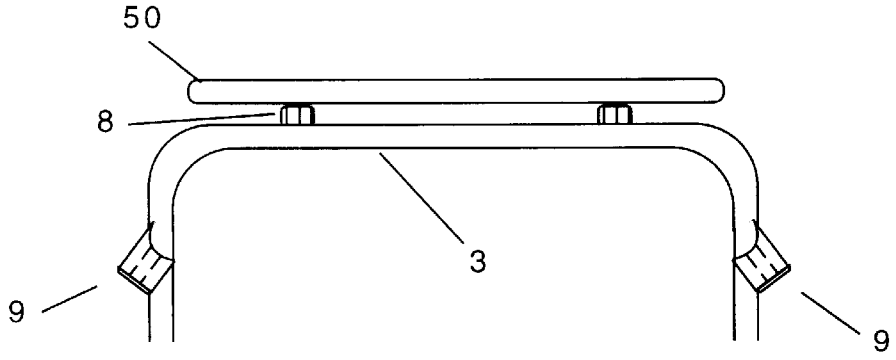
FIG. 18 is a side view of the portable table, mounted on the threaded bosses.

FIGS. 17 and 18 show use of small table 50. FIG. 17 is a top view of the table 50. The table 50 has curved edges 51 as shown. The table 50 also has a flat base 52. Several large holes 53 are provided for weight reduction. These holes 53 are arranged in pattern over the surface of the base as shown. Two ¼ inch mounting holes 54 are positioned in the base 52 as shown. These mounting holes align with the threaded bosses 8. In addition, several tapped ¼–20 holes 55 are provided around the base as shown. Holes 55 are used to secure equipment or other devices on the table. In addition, a number of tapped ¼–20 holes 56 are provided to mount and holds a number of ¼–20 screws. These holes 56 are provided only to hold the screws for storage. Finally, a washer 57 and a small NYLON line 58 are attached to the table 50. The washer 57 is used as a field screwdriver to secure the ¼–20 screws in the field. The line 58 keeps the washer 57 from being lost.

FIG. 18 shows a side view of the table as mounted to the top hoop 3. When used with various configurations of leg supports, the table 50 can be used as a bench rest for shooting, or as a table for holding a stove for cooking, eating, or other activities. When the table 50 is used as a bench rest, or the configuration of FIG. 4 is used by itself, a weight bag 60 can be used to provide further stability. FIG. 19 shows a top view of the FIG. 4 configuration with the weight bag 60 in place. The weight bag 60 has a zipper 61 and is secured to the auxiliary leg 35 using four pins 62 that fit through holes in the bag 60 and in the leg 35. The bag 60 can be filled with lead or sand for the desired weight.

Figure 20:
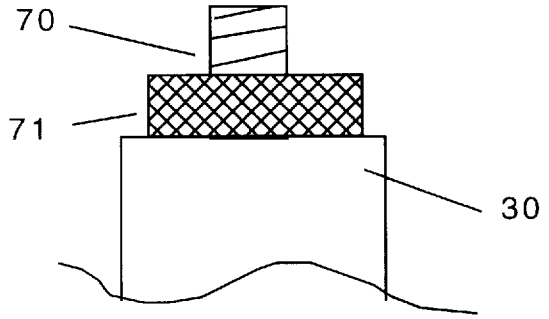
FIG. 20 is a detail view of a knurled locking nut on one of the threaded studs.

For all configuration, the lower legs can be fitted with a threaded stud 70 and a jamb nut 71 as shown in FIG. 20. This stud and jamb nut are used to level the assembly in the field. The jamb nut 71 is used to tighten up the stud 70 when final level is reached. This stud and nut combination is an option and is not preferred because dirt, mud and snow can block the threads, making the threads useless in the field. However, in bench shooting, the level studs 70 may be preferred because here, cleanliness in not a problem and greater accuracy in leveling may be needed.

Now details of actual use are discussed. FIGS. 1 and 2 show the legs, fully extended and supporting a backpack. FIG. 1 shows a spotting scope 200 in place. FIG. 2 shows the universal mount 5 and the "V" shaped gun rest 6 is mounted to the other boss 8.

FIG. 3 shows arrangement where no backpack 100 is used. Here, the legs and top hoop are used to make a support for seated shooting or spotting. The top hoop 3 has a camera 201 secured to one of the top bosses 8 (again using the universal mount 5). In this configuration, two top legs 10 extend forward from the top hoop 3 as shown. Two center legs 20 attach to the angled pieces 9 as shown, using the threaded studs 22. Two lower legs 30 are then attached to the center legs using the expanding plugs 33. By adjusting the length of the lower legs, 30 this configuration is adjustable from 17 to 24 inches in height.

FIG. 4 shows the configuration for prone shooting. This configuration uses the top hoop 3 alone, with auxiliary legs 35 being screwed into the angled members 9. Here a rifle 250 is shown in the "V" shaped gun mount 6.

Figure 21:
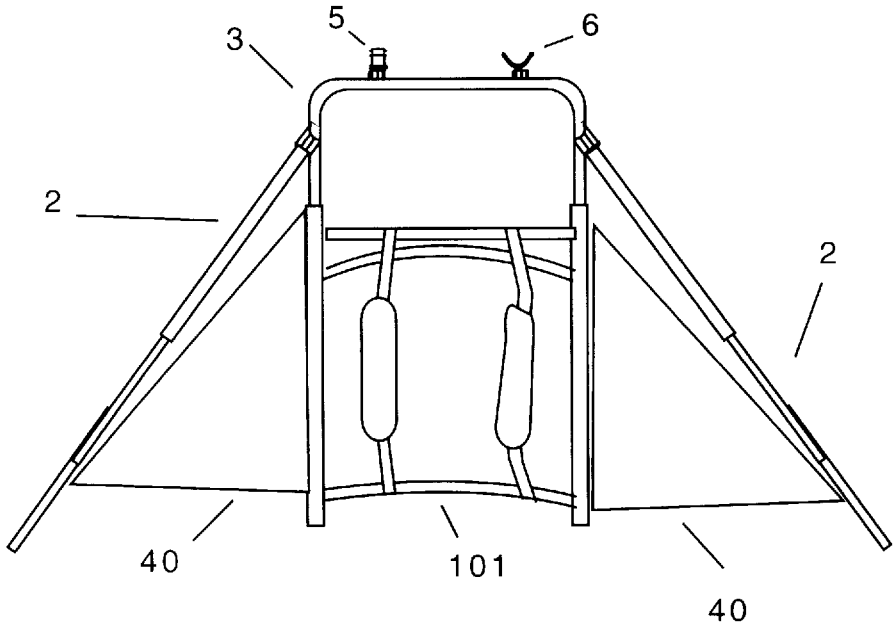
FIG. 21 is a rear view of the preferred embodiment with the side hood in place.

Finally, FIG. 21 is a rear view of the backpack assembly of FIG. 2, showing two hoods 40 in place. The hoods are attached to the backpack using the straps provided as discussed above and may be staked to the ground using the D-rings provided.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A support system for use with a backpack having an external frame comprising:

a) a top hoop, removably installed in said external frame;

b) at least one threaded boss, fixedly attached to said top loop, for securing an attachment piece thereto;

c) a pair of leg attachment members, fixedly attached to said top loop and extending outwardly therefrom;

d) a pair of telescoping leg members, removably attached to said pair of leg attachment members, said pair of telescoping leg members each having a length, wherein each leg member of said pair of telescoping leg members further includes i) a top leg member, said top leg member having a means for engaging one of said pair of leg attachment members, said top leg member also having a bottom, ii) a center leg member, said center leg member being slidably attached to the bottom of said top leg member, said center leg member also having a bottom, and iii) a bottom leg member, being slidably attached to the bottom of said center leg member;

e) a means for adjusting the length of said pair of telescoping legs; and f) a means for temporarily locking said pair of telescoping legs into a fixed length, including i) a first expansion bolt, removably attached to said center leg member, that engages said top leg member when expanded to lock said center leg member in a temporarily fixed position, and ii) a second expansion bolt, removably attached to said bottom leg member, that engages said center leg member when expanded to lock said bottom leg member in a temporarily fixed position.

2. The support system of claim 1 further comprising a pair of hoods, removably attached to said support system.

3. The support system of claim 1 further comprising a second threaded boss, fixedly attached to said top hoop.

4. The support system of claim 3 wherein a gun mount is removably attached to a threaded boss and wherein an equipment mount is removably attached to said second threaded boss.

5. The support system of claim 4 wherein a spotting scope is removably mounted to said equipment mount.

6. The support system of claim 3 further comprising a table, removably attached to said threaded bosses; and a means for attaching said table to said threaded bosses.

7. The support system of claim 1 further comprising a gun mount, removably attached to said threaded boss.

8. The support system of claim 1 further comprising an equipment mount, removably attached to said threaded boss.

9. The support system of claim 1 wherein said center leg member and said bottom leg member are temporarily fixed together and removably attached to said pair of leg attachment members to form a reduced-height support stand.

10. The support system of claim 1 further comprising a pair of auxiliary legs, said pair of auxiliary legs having a means for removably attaching said pair of auxiliary legs to said pair of leg attachment members.

11. The support system of claim 10 wherein said pair of auxiliary legs are removably attached to said pair of leg attachment members to form a further reduced-height support stand.

12. The support system of claim 11 further comprising a weight bag; and a means for attaching said weight bag to said top hoop.

13. The support system of claim 10, wherein said top leg member, said center leg member, and said bottom leg member are nested together for storage.

* * * * *